United States Patent [19]

Raden et al.

[11] Patent Number: 4,479,273

[45] Date of Patent: Oct. 30, 1984

[54] TOILET SEAT COVER LOCKING DEVICE

[75] Inventors: David T. Raden, 6821 Edgevale, Kansas City, Mo. 64113; Jack E. Hopkins, Kansas City, Mo.

[73] Assignees: David T. Raden; Gayle Kim Raden, both of Kansas City, Mo.

[21] Appl. No.: 500,879

[22] Filed: Jun. 3, 1983

[51] Int. Cl.[3] ..... A47K 13/00

[52] U.S. Cl. ..... 4/253; 4/236; 4/240

[58] Field of Search ..... 4/253, 236, 234, 235, 4/237, 238, 239, 240; 16/292, 297

[56] References Cited

U.S. PATENT DOCUMENTS

| | | | |
|---|---|---|---|
| 2,578,153 | 12/1951 | Schmitz | 4/236 |
| 2,651,053 | 9/1953 | Rowe et al. | 4/253 |
| 2,698,439 | 1/1955 | Bruckner | 4/253 |
| 2,724,125 | 11/1955 | Williams | 4/253 |
| 2,996,731 | 8/1961 | Leptrone | 4/253 |
| 3,024,472 | 3/1962 | Hardenbrook | 4/253 |
| 3,048,854 | 8/1962 | Miller | 4/253 |
| 3,056,972 | 10/1962 | Miller | 4/253 |
| 3,116,527 | 1/1964 | Springer | 24/81 |
| 3,346,888 | 10/1967 | Paysinger | 4/253 |
| 3,431,004 | 3/1969 | Schell | 292/258 |
| 4,060,861 | 12/1977 | Lawrence et al. | 4/253 |
| 4,296,504 | 10/1981 | Lawson | 4/253 |
| 4,404,695 | 9/1983 | Camp | 4/236 |

*Primary Examiner*—Henry K. Artis

*Attorney, Agent, or Firm*—D. A. N. Chase; Michael Yakimo, Jr.

[57] ABSTRACT

A locking device for a toilet seat lid comprises a rotatable lever arm having a downwardly extending flange mounted adjacent the free end thereof. The lever arm is rotatably mounted on a mounting plate with the latter being fastened to the toilet bowl to the rear of the toilet seat by means of the conventional seat-fastening bolts. The flange cooperates with the free end of the lever arm to present a jaw-like structure for receiving a portion of the rear of the closed lid therein. Upon movement of the closed lid towards an open position the lid engages the jaw-like structure in a manner which opposes movement of the lid towards a fully open position. The lever arm is user-rotatable to a position free of the closed lid to allow opening of the lid and access to the toilet bowl. A spring bias on the lever arm returns the lever arm to the original lid-receiving position upon the lid being returned to its closed position.

22 Claims, 6 Drawing Figures

TOILET SEAT COVER LOCKING DEVICE

BACKGROUND OF THE INVENTION

This invention relates to a locking device for a toilet seat and, more particularly, to a locking device utilizing a lever arm with wedge-like structure thereon operably responsive to initial swingable movement of the lid of the toilet seat in a manner precluding subsequent movement of the lid from a closed to an open position.

It is desirable to prevent access to the interior of a toilet bowl during periods of non-use particularly if small children are present about the house so as to preclude these children from throwing articles into the toilet bowl, playing with the water in the toilet bowl and from falling into the toilet bowl which may lead to drastic results.

In response thereto, many locking devices have been proposed in an attempt to assure maintenance of the toilet seat lid in a closed position during periods of non-use. However, such devices have included relatively complex structures not readily adaptable to installation on the normal toilet bowl and, once installed, have been relatively cumbersome to use. Also some of these devices present a perplexing structure to a novice user which may prevent lifting of the lid and the denial of access of the toilet bowl to an unrestricted user.

In response thereto, we have invented a locking device which is easily installed on a standard toilet bowl requiring no modifications to its structure. Moreover, operation of my device is apparent to an older child or adult so as to allow easy access to the toilet bowl to nonrestricted users. Generally, our locking device comprises a rotatable lever arm assembly having a fixed jaw-like structure at the free end thereof. After installation on the toilet a portion of the closed lid is received within the confines of the jawlike structure. Upon an attempt to swing the lid to an open position, the lid engages this structure in a manner which opposes subsequent rotation of the lid towards an open position. The lever arm is user-rotatable to a position allowing swingable movement of the lid to an open position. A spring bias on the lever arm returns the same to its locking position upon user return of the lid to a closed position.

It is, therefore, a general object of this invention to provide a locking device for a toilet seat lid which precludes undesirable access to the toilet bowl proper.

Another object of this invention is to provide a locking device, as aforesaid, which is readily and easily installed on a standard toilet bowl.

Still another object of this invention is to provide a locking device, as aforesaid, which is easily released from the toilet seat lid to allow movement of the latter to an open position.

A still more particular object of this invention is to provide a locking device with lever arm, as aforesaid, with the lever arm being biased towards a self-locking position.

A more particular object of this invention is to provide a locking device, as aforesaid, having a lever arm operably responsive to undesirable lid movement in a manner to preclude movement of the lid towards a fully open position.

Another particular object of this invention is to provide a locking device, as aforesaid, having a wedge-like structure on said lever arm interposed between the toilet seat lid and its axis of rotation so as to resist movement of the lid towards a fully open position.

Still another particular object of this invention is to provide a locking device with lever arm, as aforesaid, with the latter, in one mode of operation, being rotatable in a direction contra the direction of lid movement to resist movement of the lid towards a fully open position.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
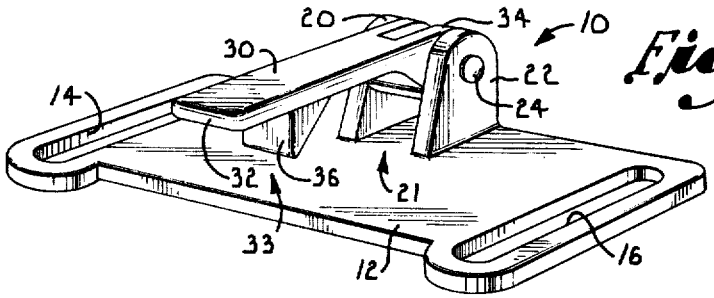
FIG. 1 is a perspective view of the locking device.
Figure 2:
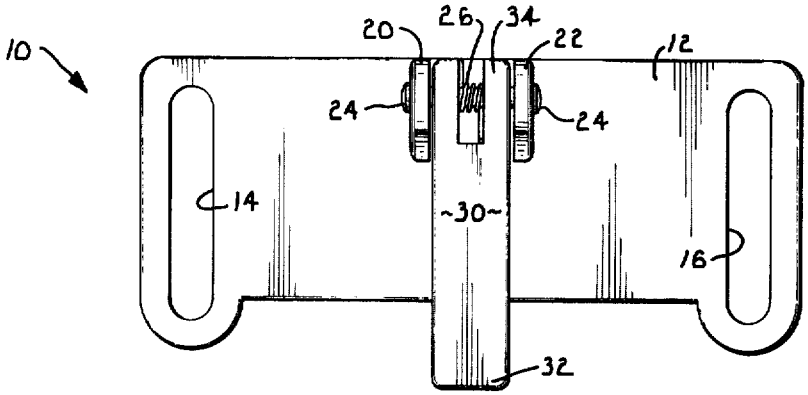
FIG. 2 is a top view of the device of FIG. 1.
Figure 3:
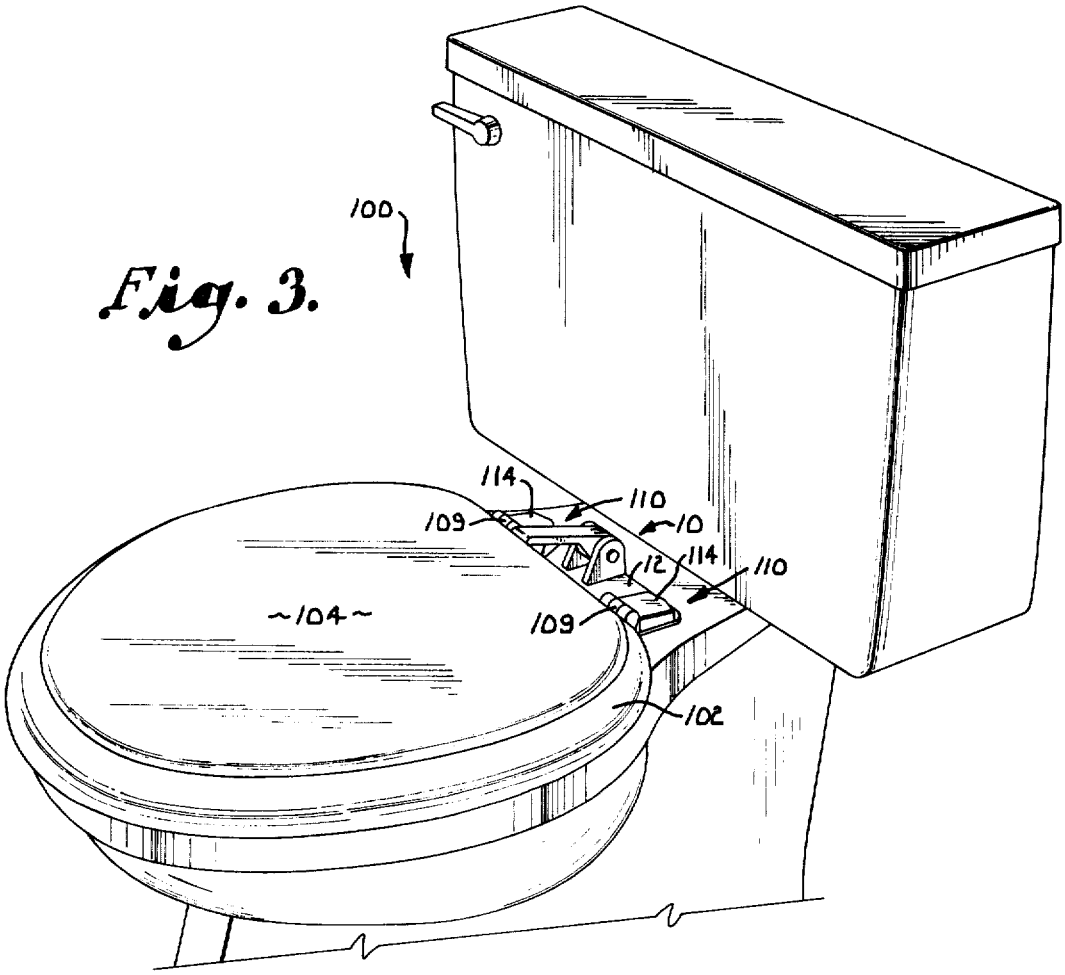
FIG. 3 is a perspective view showing the locking device installed on a standard toilet and in a lid-locking position.

Turning more particularly to the drawings, FIG. 1 shows my locking device 10 as comprising a planar mounting plate 12 having first and second elongated slots 14 and 16 thereon. Slots 14 and 16 are displaced at a distance corresponding to displacement of the standard fastening bolts 18 (only one shown) of the toilet seat assembly.

Atop the mounting plate 12 is a mounting bracket 21 as presented by first and second upright lobes 20 and 22 having a horizontal pin member 24 passing therethrough. Wrapped about the pin member 24 is a spring member 26, associated with lever arm 30, which offers a directional bias to lever arm 30 in a manner and for a purpose to be subsequently described.

The lever arm 30 has first 32 and second 34 longitudinally spaced-apart end members with the second end 34 being swingably mounted about a horizontal axis as defined by the pin member 24. Downwardly extending from the first end 32 of lever arm 30, and generally normal thereto, is a flange member 36 as shown in FIG. 1. This flange member cooperates with the end 32 of arm 30 to present a fixed jaw-like structure generally designated as 33.

The locking device 10 is used with a conventional toilet 100 having a toilet seat 102 with a lid 104 thereon. Lid 104 is swingably mounted to the seat 102 as provided by laterally spaced-apart pivot arms 108 (one shown) rotatable about pivot pins 109. Pivot arms 111 (one shown) allow for rotation of the seat 102 about the common pivot pin 109. As shown, each mounting flange 110 has a cover member 114 at the top end thereof to hide the top of the respective fastening bolts 18 (one shown) passing therethrough.

OPERATION

In operation the seat/lid assembly is first removed with the mounting plate 12 then being placed atop the toilet bowl. The first and second slots 14, 16 are then aligned with the conventional bolt apertures (not shown) for projection of the conventional bolts 18 therethrough used to attach the seat 102 atop the toilet bowl. The mounting flanges 110 of seat 102 are then placed atop the respective slots 14, 16 with bolts 18 then being inserted through the flanges 110, slots 14, 16 and bolt apertures. Nuts 19 are then first loosely engaged about the ends of the bolts 18.

Figure 4:
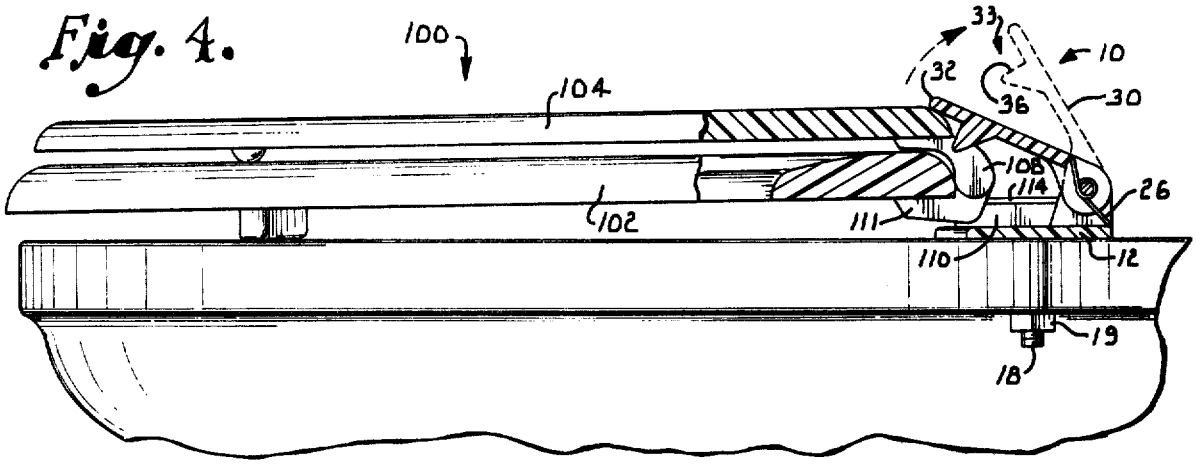
FIG. 4 is a side elevation view of the device in FIG. 3 with a portion of the device and toilet seat being sectioned to show the relationship of the device with a closed toilet seat lid.

With the lid 104 in its closed position, as shown in FIG. 4, the lever arm 30 is positioned so that the jaw-like structure 33 receives a portion of the lid 104 therein. As shown, flange member 36 of the structure 33 nearly abuts the lower edge of the seat 104 with the protruding portion of the first end 32 of the lever arm 30 beyond flange 36 resting generally atop the top edge of the toilet seat lid 104. This desired location of the jaw-like structure 33, relative to the portion of the toilet seat lid 104 and the axis of rotation 109 of the lid 104, is achieved by back-and-forth slidable movement of the mounting plate 12 as provided by the elongated slots 14, 16. The rotation of the arm 32 allows for vertical adjustment of the structure 33 corresponding to various heights of lid 104 above the toilet bowl 100. Once properly positioned, as shown in FIG. 4, the bolts 19 are then securely fastened to prevent any further slidable movement of the plate 12 which maintains the locking device 10 in a desired position relative to the lid 104 of the toilet seat assembly.

In one mode of operation, the flange 36, presents a bearing surface rearwardly adjacent the lower edge of lid 104 and interposed between the lid 104 and its axis of rotation as presented by the pivot pin 109. Upon movement of the lid 104 towards an open position, as provided by rotation of the respective pivot arms 108 about the common pin members 109, the portion of the lid 104 between the first and second flanges 32, 36 is wedged therebetween with the lower edge of the lid 104 preferrably abutting this bearing surface 36. Further movement of the lid 104 towards its open position is inhibited as forces directed against structure 33 by the lid 104 result in coactive restraining forces which resist further rotation of the pivot arms 108 about their respective pivot pin 109. It is herein noted that the axis of rotation 24 of the lever arm 36 is offset from the axis of rotation 109 of the lid 104. Accordingly, the forces produced by a small child lifting the lid 104 are insufficient to rotate the lever arm 32 to a position freeing the wedged portion of the lid 104 from structure 33. Thus further rotation of the entire lid 104 beyond that position, generally shown in FIG. 5, is inhibited which in turn restricts access to the interior of the toilet bowl 100 proper.

Figure 5:
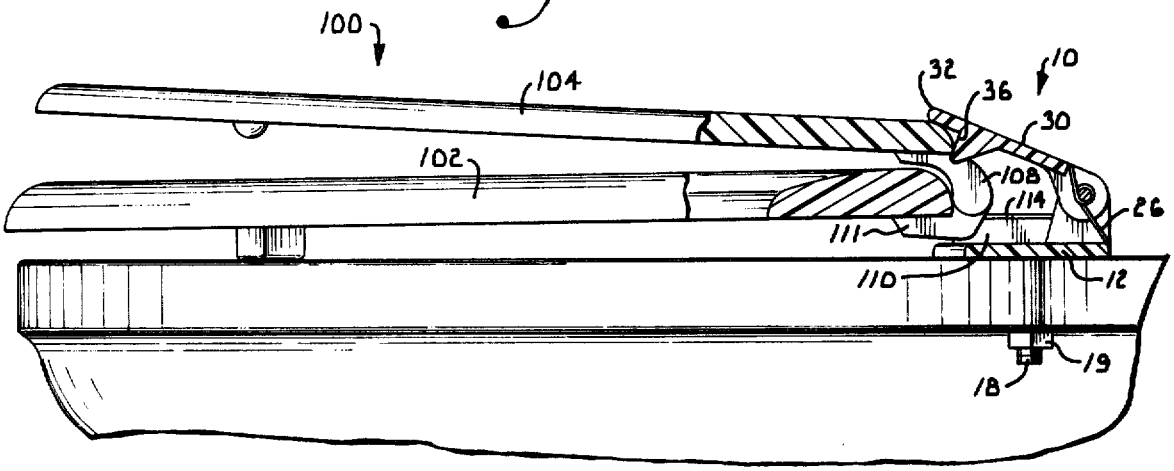
FIG. 5 is a side elevation view, as in FIG. 4, and showing the locking action of the lever arm of the locking device with the lid upon rotation of the lid towards an open position.

In a second mode of operation, movement of the lid member 104 towards an open position causes the lower edge of the lid member to bear against the flange 36, as shown in FIG. 5. This bearing relationship urges the flange 36 and lever arm 30 linked thereto to seek rotation about its pin member 24. This rotation, contra to the rotation of the lid 104 to a fully open position, causes the second flangelike end 32 of lever arm 30 to bear against the top edge of lid 104 so as to resist movement of the portion of the lid 104 received in the jaw-like structure 33, i.e. between flanges 36 and flange-like end 32 of lever arm 30. Thus further rotation of the entire lid 104 is precluded beyond that position, generally shown in FIG. 5, which in turn restricts access to the interior of the toilet bowl 100 proper.

Figure 6:
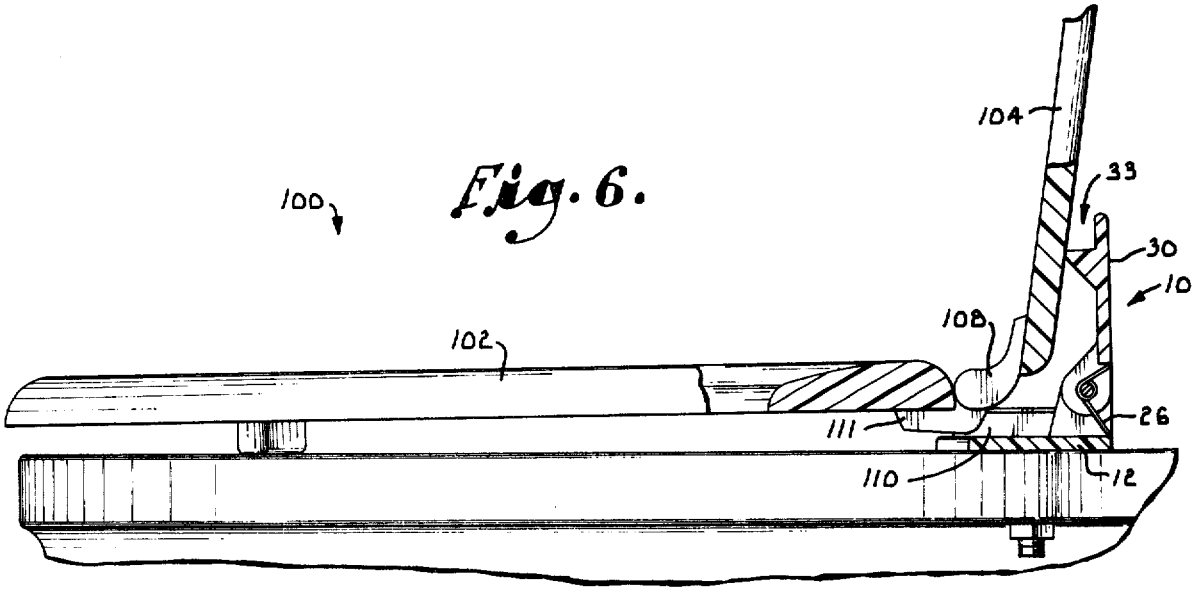
FIG. 6 is a side elevation view, as in FIGS. 4 and 5, and showing the lever arm of the locking device disengaged from the toilet seat lid so as to allow movement of the lid towards a fully open position.

As shown in FIG. 6, the lever arm 30 is user-rotatable away from the lid 104 to allow rotation of the lid member 104 to a fully open position and a desirable access to the toilet bowl 100. Upon the lid 104 being lowered to the closed position, as shown in FIG. 4, the spring 26 bias on lever arm 30 rotates the lever arm 30 in a counter-clockwise direction so that the jaw-like structure 33, with fixed flanges 26 and 32 thereon is returned to its locking position, as shown in FIG. 4.

Accordingly, my device 10 uses a lever arm 30 with jaw-like structure 33 rotatable about an axis 24 displaced from the axis of rotation of the toilet seat lid 104. Initial clockwise rotation of the lid 104 towards an open position causes engagement of the lid 104 with structure 33 so as to oppose further movement of the lid 104. This opposition is presented by either the wedge-like relationship of the lid 104 with structure 33 or by contra rotation of the lever arm 30 both as above-described. In either case these opposing relationships preclude subsequent movement of the portion of lid 104 received in the jaw-like structure 33 and thus precludes swingable movement of the entire toilet seat lid 104 to an open position. Our device 10 is apparently releasable from the toilet seat lid 104 by informed users so as to allow access to the toilet bowl with the spring bias 26 therein assuring return of the lever arm 30 to the locking position.

It is to be understood that while a certain form of this invention has been illustrated and described, it is not limited thereto, except in so far as such limitations are included in the following claims.

Having thus described the invention, what is claimed as new and desired to be secured by Letters Patent is:

1. For use with a toilet bowl having a seat member with lid rotatable between open and closed positions for controlling access to said toilet bowl, a locking device for said lid comprising:

an arm member having first and second displaced ends;

structure on said first end of said arm member for engaging a portion of said lid;

means for mounting said second end of said arm member in rotation about an axis passing therethrough; and means for locating said structure at a position adjacent said portion of said lid for said engagement upon an initial rotation of said lid towards said open position, said engagement urging said arm with said structure thereon in rotation about said axis contra said rotation of said lid to resist subsequent lid rotation towards said open position.

2. The apparatus as claimed in claim 1, wherein said structure comprises first and second intersecting flange members for receiving said portion of said lid therebetween, said lid upon rotation contacting at least one of said flange members to rotate said arm member and the other of said flange members in said contra direction resistive to subsequent rotation of said lid portion positioned between said flanges.

3. The apparatus as claimed in claim 1, wherein said structure comprises at least a first flange member extending downwardly from said arm and below said adjacent lid portion to a position whereby rotation of said lid member causes an edge of said lid to contact said first flange member and urge the same in a direction providing for said contra rotation of said associated arm.

4. The apparatus as claimed in claim 3, wherein said structure further comprises a second flange member generally extending in the direction of said arm and above said adjacent lid portion to a position whereby said contra rotation of said arm causes said second flange to bear upon said lid in a manner to resist movement of said lid portion in a direction corresponding to rotation of said lid towards said open position.

5. The apparatus as claimed in claim 1, wherein said seat member is fastened to said toilet bowl by bolt means extending through apertures in said toilet bowl and wherein said locating means comprises:

a plate member designed to lie atop said toilet bowl with said mounting mean thereon; and bolt receiving orifices in said plate member for alignment with said bolt apertures to allow for projection of said bolt means therethrough and interposition of said plate member between a portion of said seat and said toilet bowl.

6. The apparatus as claimed in claim 5, wherein said bolt receiving orifices are elongated slots allowing for slidable back-and-forth movement of said plate relative to said bolts projecting therethrough, said slidable movement providing for a relative positioning of said plate on said bowl in a manner to align said structure at said position adjacent said portion of lid.

7. The apparatus as claimed in claim 5, wherein said mounting means comprises:

a bracket member upwardly extending from said plate; and a pin member extending through said bracket and said second arm of said arm member to provide said axis of rotation therethrough.

8. The apparatus as claimed in claim 1, wherein said arm member is user rotatable about said axis in the same direction as said lid to displace said structure away from said adjacent lid to a position allowing for user rotation of said lid to said open position.

9. The apparatus as claimed in claim 8 further comprising bias means for urging said arm member in a position contra the direction of said rotation of said lid to return said structure towards said position adjacent said portion of said lid upon user rotation of said lid to said closed position.

10. For use with a toilet bowl having a seat member with lid rotatable between open and closed positions for controlling access to said toilet bowl, a locking device for said lid comprising:

a lever arm having first and second displaced ends;

linkage means adjacent said first end of said arm member for engaging a portion of said lid;

means for mounting said second end of said lever arm in rotation about an axis passing therethrough; and means for locating said linkage means at a position adjacent said portion of said lid for engagement therewith upon an initial rotation of said lid towards said open position, said linkage means causing said lever arm to be responsive to said engagement in a manner resistive to movement of said lid portion corresponding to subsequent rotation of said lid to said open position.

11. For use with a toilet bowl having a seat member with lid rotatable between open and closed positions for controlling access to said toilet bowl, a locking device for said lid comprising:

a lever arm having first and second displaced ends;

a first flange member generally adjacent said first end and downwardly depending therefrom;

means for mounting said second end of said lever arm in rotation about an axis passing therethrough; and means for locating said first flange member at a position adjacent a portion of said lid and generally extending towards the underside of said lid with said first end of said arm extending towards the topside of said lid, said first flange engageable by a portion of said lid upon an initial rotation of said lid towards said open position with said engagement urging said first flange and lever arm in a direction causing said lever arm to bear on said lid portion whereby to resist subsequent lid rotation to said open position.

12. For use with a toilet bowl having a seat member with lid rotatable about a generally horizontal axis between open and closed positions for controlling access to said toilet bowl, a locking device for said lid comprising:

an arm member having first and second displaced ends;

wedge means on said first end of said arm member for engaging a portion of said lid; and means for locating said wedge means at a position rearwardly adjacent said portion of said lid and forward of said horizontal axis for engaging said lid portion upon an initial rotation of said lid towards said open position, said engagement resisting subsequent rotation of said lid about said horizontal axis and subsequent movement of the same towards said open position.

13. The apparatus as claimed in claim 1, wherein said wedge means comprises first and second intersecting flange members for receiving said portion of said lid therebetween, said lid upon rotation engaging at least one of said flange members in a manner resisting subsequent rotation of said lid portion between said flanges and said lid towards said open position.

14. The apparatus as claimed in claim 12, wherein said wedge means comprises at least a first flange member extending downwardly from said arm and forward of said horizontal axis to a position whereby rotation of said lid member causes an edge of said lid portion to immediately contact said first flange member in a manner resisting subsequent rotation of said lid towards said open position.

15. The apparatus as claimed in claim 14, wherein said wedge means further comprises a second flange member for resting atop a surface of said adjacent lid portion to maintain said first flange member in said position relative to said lid portion.

16. The apparatus as claimed in claim 12, wherein said seat member is fastened to said toilet bowl by bolt means extending through apertures in said toilet bowl and wherein said locating means comprises:

a plate member designed to lie atop said toilet bowl with said mounting mean thereon;

means for mounting said arm member atop said plate; and bolt receiving orifices in said plate member for alignment with said bolt apertures to allow for projection of said bolt means therethrough and interposition of said plate member between a portion of said seat and said toilet bowl.

17. The apparatus as claimed in claim 16, wherein said bolt receiving orifices are elongated slots allowing for slidable back-and-forth movement of said plate relative to said bolt means projecting therethrough, said slidable movement providing for a relative positioning of said plate on said bowl in a manner to align said wedge means at said position adjacent said portion of said lid.

18. The apparatus as claimed in claim 16, wherein said mounting means includes means for rotating said second end of said arm member about a generally horizontal axis passing therethrough whereby to vertically adjust said first end of said arm member and wedge means thereon relative to said portion of said lid.

19. The apparatus as claimed in claim 18, wherein said rotating means comprises:

a bracket member upwardly extending from said plate; and a pin member extending through said bracket and said second arm of said arm member to present an axis of rotation to said arm member and said rotation thereto.

20. The apparatus as claimed in claim 17, wherein said mounting means includes means for rotating said second end of said arm member about a generally horizontal axis passing therethrough whereby to vertically adjust said first end of said arm member and wedge means thereon relative to said portion of said lid.

21. The apparatus as claimed in claim 18, wherein said arm member is user-rotatable in the same direction as said lid to displace said wedge means away from said adjacent lid to a position allowing for free user rotation of said lid about said horizontal axis.

22. The apparatus as claimed in claim 21 further comprising bias means for urging said arm member in a position contra the direction of said rotation of said lid to return said wedge means towards said position adjacent said portion of said lid upon user rotation of said lid to said closed position.

* * * * *

UNITED STATES PATENT AND TRADEMARK OFFICE

CERTIFICATE OF CORRECTION

PATENT NO. : 4,479,273

DATED : October 30, 1984

INVENTOR(S) : DAVID T. RADEN et al

It is certified that error appears in the above—identified patent and that said Letters Patent is hereby corrected as shown below:

Column 6, Line 33, Claim 13, change "1" to --12--.

Signed and Sealed this

*Twenty-third* Day of *April 1985*

[SEAL]

*Attest:*

DONALD J. QUIGG

*Attesting Officer*

*Acting Commissioner of Patents and Trademarks*